US005303856A

United States Patent [19]

Weatherholt, Sr.

[11] Patent Number: 5,303,856

[45] Date of Patent: Apr. 19, 1994

[54] SOCK DONNING APPARATUS

[76] Inventor: Roger W. Weatherholt, Sr., Rte. 4, Box 494, Front Royal, Va. 22630

[21] Appl. No.: 56,318

[22] Filed: May 3, 1993

[51] Int. Cl.[5] ..... A47G 25/80

[52] U.S. Cl. ..... 223/111; 223/112; 223/120

[58] Field of Search ..... 223/111, 112, 120, 113, 223/119, 116

[56] References Cited

U.S. PATENT DOCUMENTS

| | | | |
|---|---|---|---|
| 2,894,669 | 7/1959 | Silken | 223/111 |
| 2,903,170 | 9/1959 | Ahn | 223/111 |
| 3,604,604 | 9/1971 | Ahn | 223/111 |
| 3,991,920 | 11/1976 | Hall | 223/111 |
| 3,993,228 | 11/1976 | Fuhr | 223/111 |
| 5,050,783 | 9/1991 | Hunter | 223/112 |
| 5,069,374 | 12/1991 | Williamson et al. | 223/112 |

FOREIGN PATENT DOCUMENTS

| | | | |
|---|---|---|---|
| 3203266 | 1/1983 | Fed. Rep. of Germany | 223/111 |

*Primary Examiner*—Clifford D. Crowder
*Assistant Examiner*—Bibhu Mohanty
*Attorney, Agent, or Firm*—Leon Gilden

[57] ABSTRACT

A support post is arranged to slidably mount a guide tube having a platform secured thereon. The platform includes a support arm, with the support arm mounting a generally U-shaped support plate that is oriented at an obtuse angle relative to the platform, with the platform arranged for reciprocation along the support post and the support plate arranged to receive a sock thereon from a first raised position to a second lowered position to permit ease of donning to an individual's foot.

5 Claims, 4 Drawing Sheets

FIG. 1
PRIOR ART
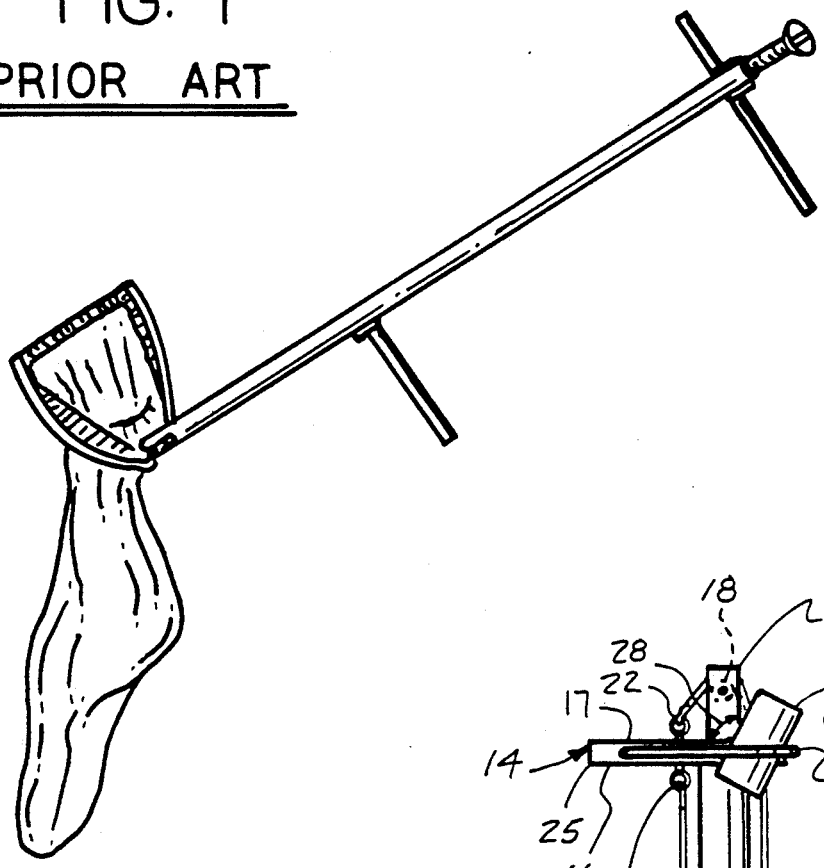
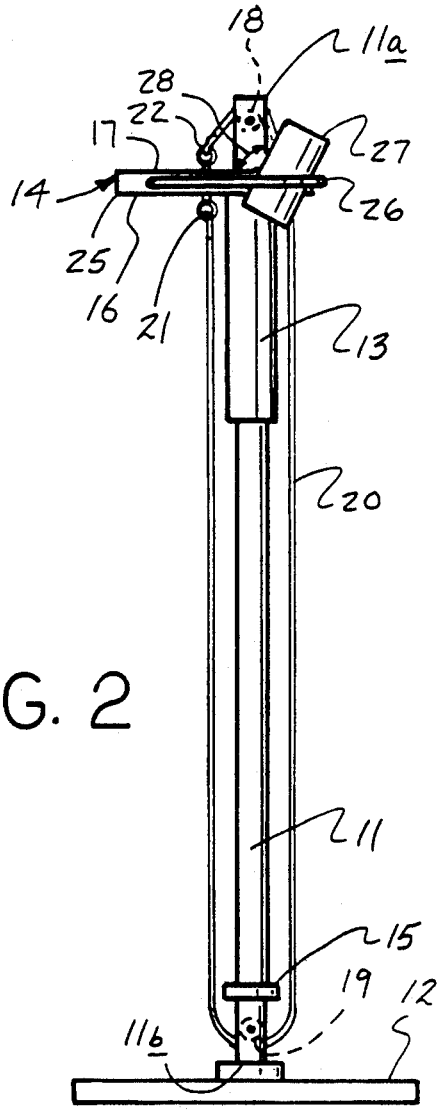
FIG. 2

SOCK DONNING APPARATUS

BACKGROUND OF THE INVENTION

1. Field of the Invention

The field of invention relates to sock donning apparatus, and more particularly pertains to a new and improved sock donning apparatus wherein the same is arranged to ease insertion of an individual's foot within a sock member.

2. Description of the Prior Art

Various hosiery and sock donning apparatus is indicated in the prior art, such as exemplified by the U.S. Pat. Nos. 4,516,704; 4,497,424; 5,050,783; and 4,284,216.

The instant invention attempts to overcome deficiencies of the prior art by providing for a stationary post member arranged to provide a reciprocating platform to permit ease of mounting a sock to the platform and subsequently permit its lowering in the donning procedure and in this respect, the present invention substantially fulfills this need.

SUMMARY OF THE INVENTION

In view of the foregoing disadvantages inherent in the known types of sock donning apparatus now present in the prior art, the present invention provides a sock donning apparatus wherein the same includes a reciprocating platform arranged to mount a sock thereon. As such, the general purpose of the present invention, which will be described subsequently in greater detail, is to provide a new and improved sock donning apparatus which has all the advantages of the prior art sock donning apparatus and none of the disadvantages.

To attain this, the present invention provides a support post arranged to slidably mount a guide tube having a platform secured thereon. The platform includes a support arm, with the support arm mounting a generally U-shaped support plate that is oriented at an obtuse angle relative to the platform, with the platform arranged for reciprocation along the support post and the support plate arranged to receive a sock thereon from a first raised position to a second lowered position to permit ease of donning to an individual's foot.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sock donning apparatus which has all the advantages of the prior art sock donning apparatus and none of the disadvantages.

It is another object of the present invention to provide a new and improved sock donning apparatus which may be easily and efficiently manufactured and marketed.

It is a further object of the present invention to provide a new and improved sock donning apparatus which is of a durable and reliable construction.

An even further object of the present invention is to provide a new and improved sock donning apparatus which is susceptible of a low cost of manufacture with regard to both materials and labor, and which accordingly is then susceptible of low prices of sale to the consuming public, thereby making such sock donning apparatus economically available to the buying public.

Still yet another object of the present invention is to provide a new and improved sock donning apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art sock donning apparatus, as indicated in U.S. Pat. No. 5,050,783.

FIG. 2 is an orthographic view of the invention.

DESCRIPTION OF THE PREFERRED EMBODIMENT

Figure 3:
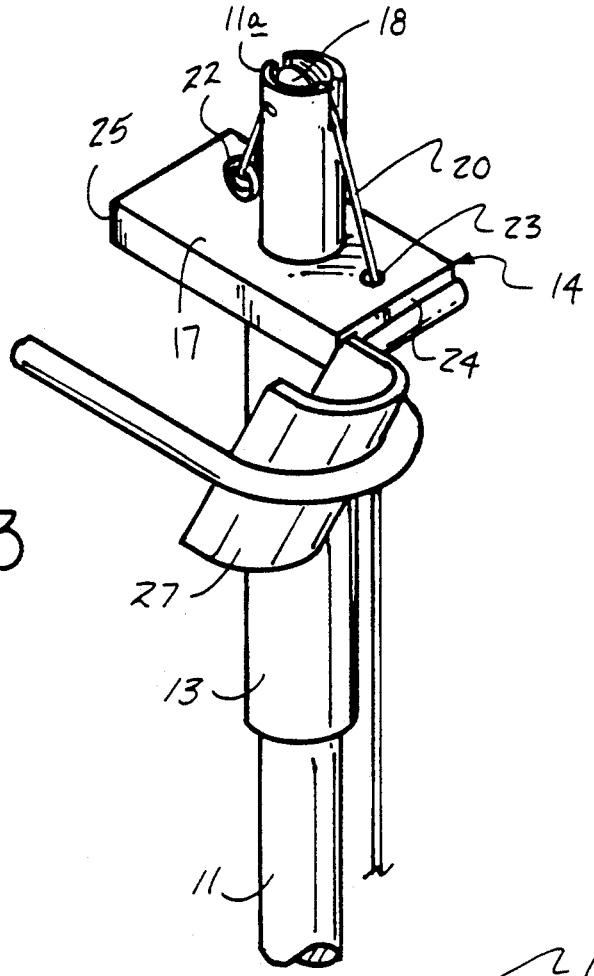
FIG. 3 is an isometric illustration of an uppermost portion of the organization.

With reference now to the drawings, and in particular to FIGS. 1 to 8 thereof, a new and improved sock donning apparatus embodying the principles and concepts of the present invention and generally designated by the reference numerals 10 and 10*a* will be described.

More specifically, the sock donning apparatus 10 of the instant invention essentially comprises a support post 11 mounted fixedly to a base plate 12 at the support post second end 11*b* that is spaced from the free support post first end 11*a*. A guide tube 13 is slidably mounted about the support post, having a platform 14 fixedly mounted to the guide tube uppermost end. An abutment flange 15 is secured fixedly about the support post in spaced adjacency to the support post second end 11*b*, with a second pulley 19 oriented between the abutment flange 15 and the support post second end 11*b*, as illustrated, with a first guide pulley 18 mounted to the support post 11 in adjacency to the support post first end 11*a*. The pulleys 18 and 19 are mounted within the support post, having access slots therethrough such as indicated in FIG. 3 to receive a flexible guide line 20 about the first and second pulleys 18 and 19 respectively. The guide line 20 includes a guide line first end 22 mounted to the platform top wall 17, with a guide line second end 22 mounted to the platform bottom wall 16 to a first side of the post 11 in adjacency to the platform second end 25. A guide opening 23 is directed through the platform in adjacency to the platform first end 24 at a second side of the support post 11. A guide line 20 is accordingly directed through the guide opening 23 to maintain alignment of the guide line relative to the platform structure.

Figure 4:
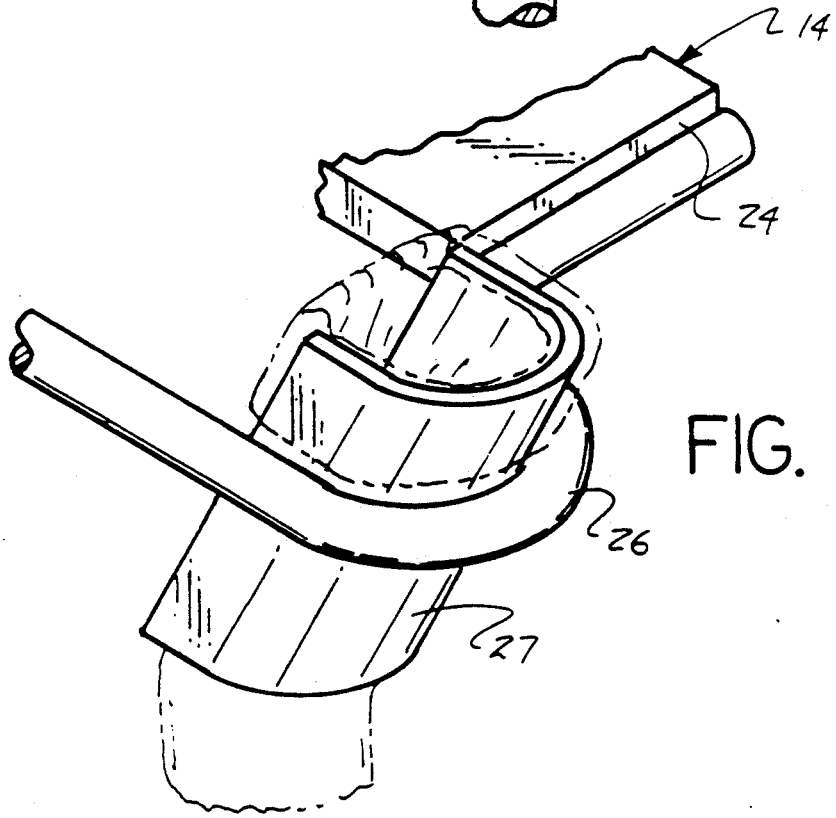
FIG. 4 is an enlarged isometric illustration of the sock donning support plate of the invention.
Figure 7:
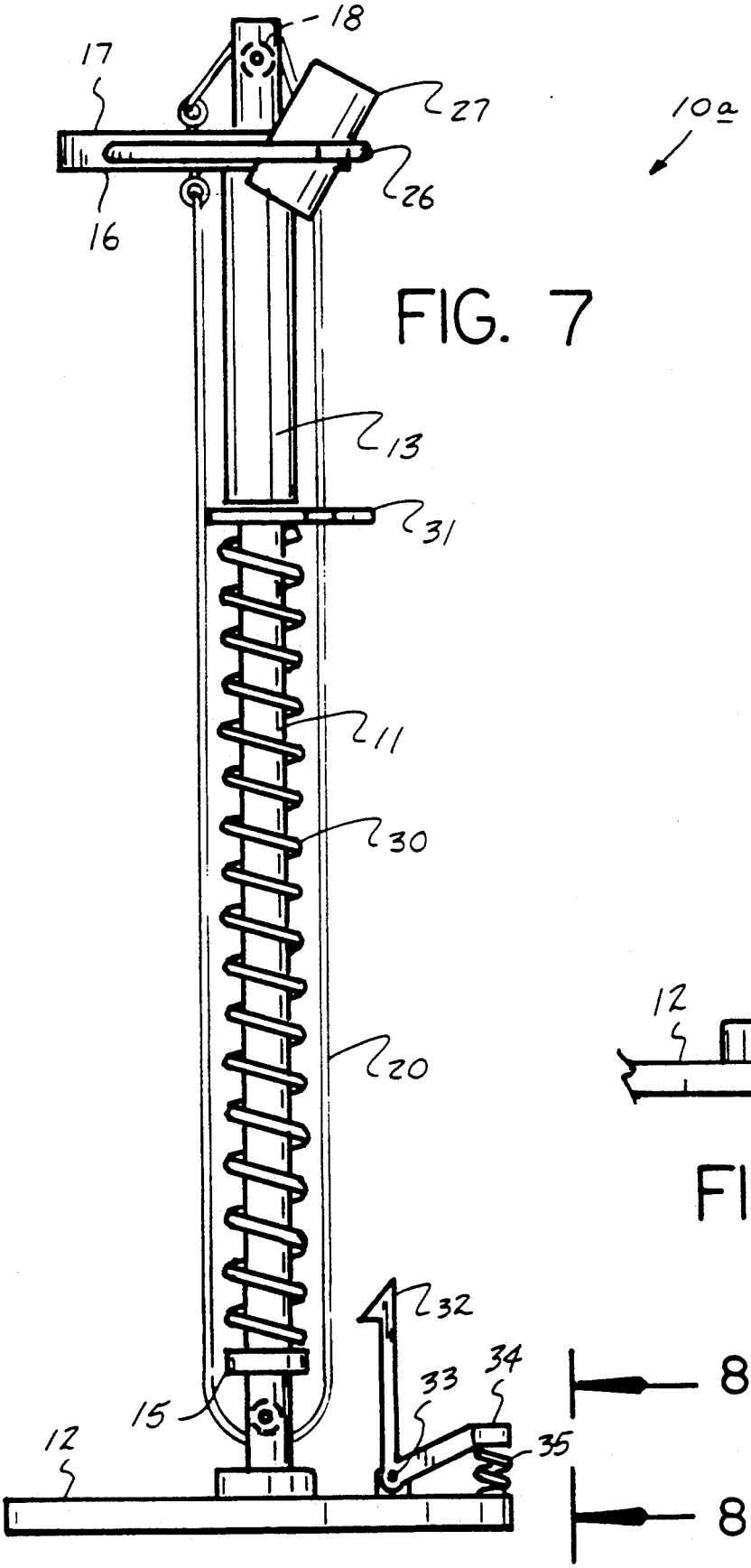
FIG. 7 is an orthographic view of a modified aspect of the invention.
Figure 8:
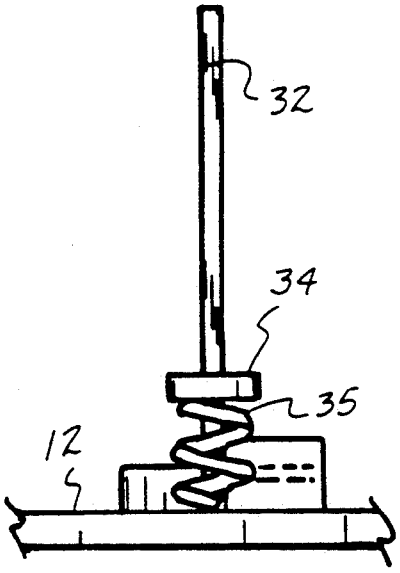
FIG. 8 is an orthographic view, taken along the lines 8—8 of FIG. 7 in the direction indicated by the arrows.

A support arm 26 extends from the platform laterally offset therefrom, having a U-shaped support plate 27 mounted fixedly to the support arm 26, with the support plate 27 oriented at an oblique angle relative to the platform top wall, as indicated in FIGS. 2 and 7 for example. A sock member, as illustrated in FIG. 4, is positioned about an uppermost end of the support plate 27 providing for extending of the sock entrance opening to permit the insertion of an individual's foot therewithin, wherein the platform is directed from the first position, as indicated in FIG. 2, to a second lower position, with the platform generally oriented and in abutment with the abutment flange 15.

Figure 5:
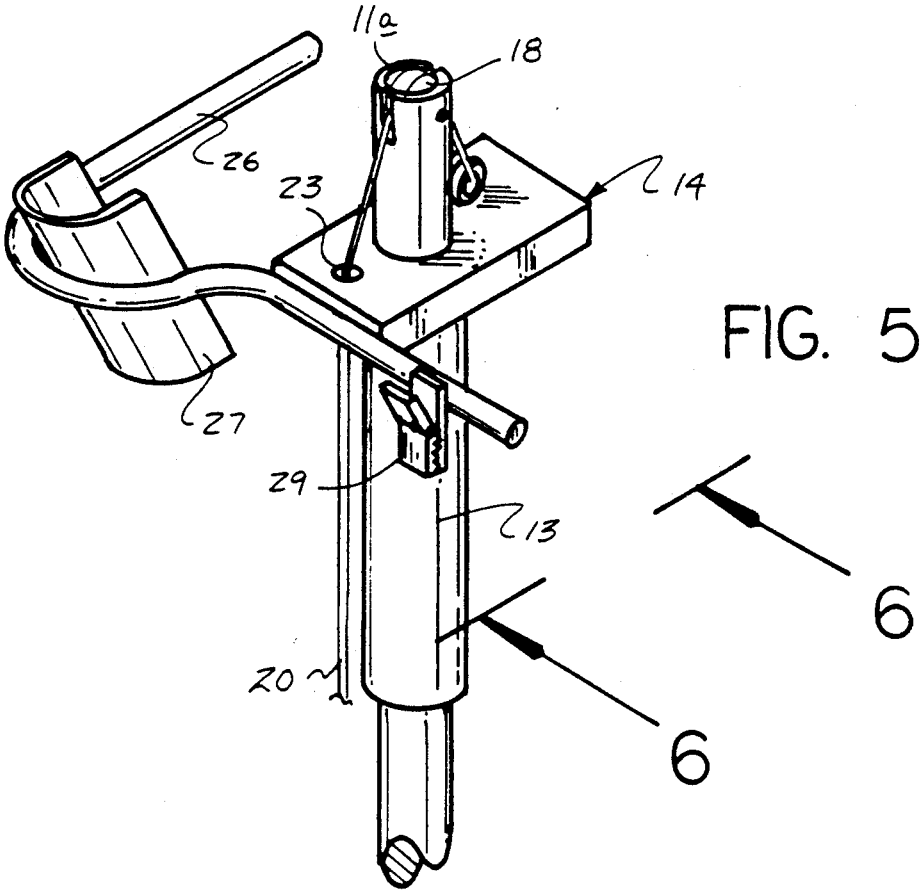
FIG. 5 is an isometric illustration of the invention employing a shoe securing clamp.
Figure 6:
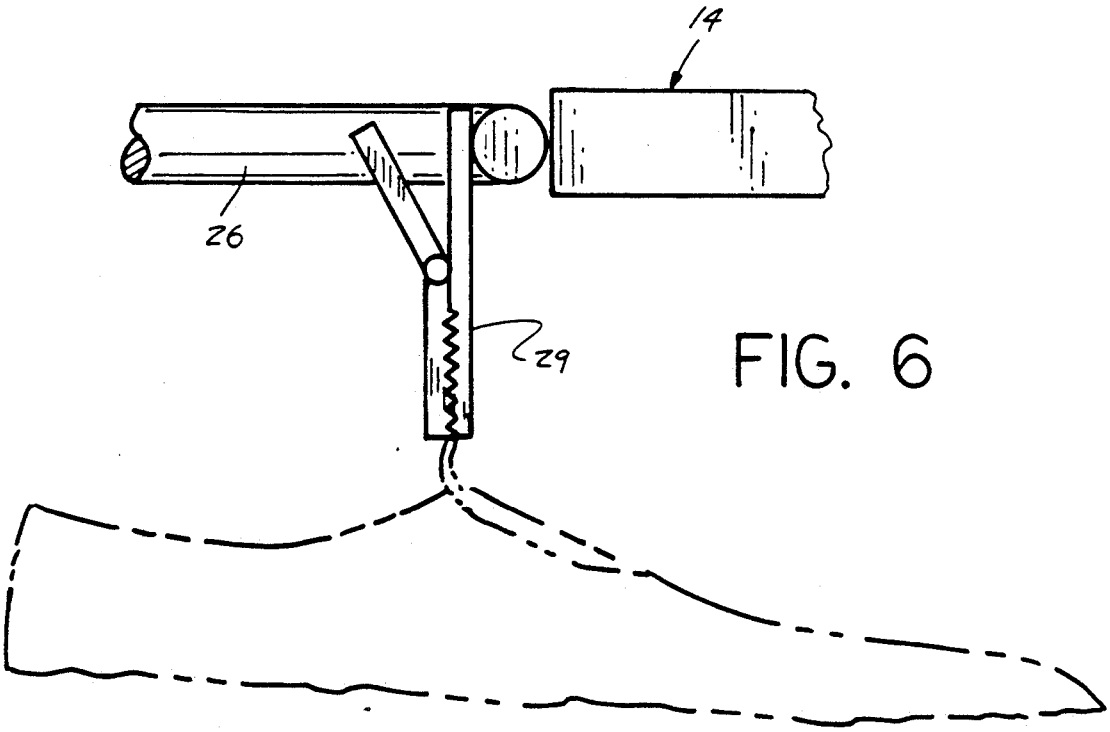
FIG. 6 is an orthographic view, taken along the lines 6—6 of FIG. 5 in the direction indicated by the arrows.

The FIGS. 5 and 6 indicate the additional use of a support clamp 29 mounted to the support arm 26 on an opposed side of the platform relative to the support plate 27, wherein the support clamp 26 is arranged to secure an individual's shoe thereon to thereby in a single operation permit the shoe to be lowered, whereupon subsequent to an individual donning an associated sock member, the individual merely inserts that foot into the associated shoe, as indicated in phantom is FIG. 6, when in the lowered position and thereby removes the shoe from the clamp upon donning the shoe structure subsequent to donning the sock.

The FIG. 7 indicates the apparatus 10*a* to additionally include relative to the structure, as indicated in FIGS. 1–6, a first spring 30 oriented between the abutment flange 15 and the guide tube 13, with the spring having a spring plate 31 arranged for engaging the guide tube, such that upon lowering of the guide tube to the second position, the spring is compressed, whereupon compression of the spring, the spring plate 31 is engaged by a latch leg 32 pivotally mounted about a latch leg axle 33. The latch leg includes a latch leg extension leg 34, having a second spring 35 interposed between the extension leg 34 and the base plate 12. In this manner, compression of the second spring 35 displaces the latch leg 32 relative to the spring plate, whereupon release of the latch leg extension leg 34 permits the latch leg 32 to engage the spring plate and secure the platform in a biased second position in abutment with the abutment flange 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A sock donning apparatus, comprising, a support post, the support post including a support post first end spaced from a support post second end, with a base plate mounted to the support post second end, and a platform having a guide tube, with the platform having a platform top wall spaced from a platform bottom wall, and the guide tube mounted to the platform at the platform bottom wall, said support post slidably directed through said guide tube, and drive means to permit reciprocation of the platform from a first position in adjacency to the post first end to a second position in adjacency with the support post second end, and a support arm mounted to the platform extending laterally of the platform, the support arm having a U-shaped support plate fixedly mounted to the support arm in spaced adjacency to the platform, with the U-shaped support arm oriented at an obtuse angle relative to the platform top wall, with the support plate extending above and below the support arm and above and below the platform.

2. An apparatus as set forth in claim 1 wherein the drive means includes a first pulley mounted within the support post in adjacency to the support post first end, and a second pulley mounted within the support post in adjacency to the support post second end between the support post second end and an abutment flange, and a flexible guide line extending around the first pulley and the second pulley directed through the support post at the first pulley and directed to the support post at the second pulley, with the guide line having a guide line first end mounted to the platform top wall, and a pulley second end mounted to the platform bottom wall, whereupon displacement of the guide line about the first pulley and the second pulley effects displacement of the platform between the first position and the second position.

3. An apparatus as set forth in claim 2 including a guide opening directed through the platform, wherein the guide line first end and the guide line second end are mounted to the platform in adjacency to a platform second end, and the guide opening directed through the platform in adjacency to a platform first end to provide guidance of the guide line relative to the platform.

4. An apparatus a set forth in claim 3 wherein the support arm further includes a support clamp arranged for mounting a shoe thereon, wherein the support clamp extends relative to a first side of the platform, with the support plate extending relative to a second side of the platform.

5. An apparatus as set forth in claim 4 including a spring plate mounted between the abutment flange and the guide tube, and a first spring interposed between the spring plate and the abutment flange to bias the platform to the first position, and a latch leg having a latch leg axle pivotally mounting the latch leg relative and in adjacency to the base plate, with the latch leg further including a latch leg extension leg extending beyond the latch leg axle, with a second spring interposed between the extension leg and the base plate, wherein the latch leg is arranged for engaging the spring plate in the second position, with the second spring biasing the latch leg to engage the spring plate in the second position.

* * * * *